United States Patent [19]

Young

[11] Patent Number: 4,997,495

[45] Date of Patent: Mar. 5, 1991

[54] CONCENTRATE-PHASE SENSITIZED WATER-CONTAINING EXPLOSIVES

[75] Inventor: Paul R. Young, Oakmont, Pa.

[73] Assignee: W. R. Grace & Co.-Conn., Lexington, Mass.

[21] Appl. No.: 472,923

[22] Filed: Jan. 31, 1990

[51] Int. Cl.[5] ..... C06B 45/00

[52] U.S. Cl. ..... 149/2; 149/21; 149/60; 149/61; 149/89; 149/90; 149/109.6

[58] Field of Search ..... 149/2, 21, 60, 61, 89, 149/90, 109.6

[56] References Cited

U.S. PATENT DOCUMENTS 4,736,683 4/1988 Bauhman et al. ..... 149/60

4,867,813 9/1989 Young ..... 149/2

*Primary Examiner*—Stephen J. Lechert, Jr.

*Attorney, Agent, or Firm*—Rothwell, Figg, Ernst & Kurz

[57] ABSTRACT

Water-containing explosives, such as emulsions, slurries and water gels, are sensitized in their emulsion (concentrate) phases with sensitizing energy release agents based on nitroalkanes and nitroalkane blends including arene coupling agents. The sensitizing energy release agents are miscible with the concentrate phase and remain stable therein.

38 Claims, No Drawings

CONCENTRATE-PHASE SENSITIZED WATER-CONTAINING EXPLOSIVES

BACKGROUND OF THE INVENTION

The present invention relates to improvements to water-containing explosives. More particularly, the invention relates to concentrate-phase sensitization (with mixtures of nitroalkanes and arenes) of such explosives to provide highly efficient and stable explosives.

Water-containing explosives, such as emulsions, are based on water-in-oil dispersions having a discontinuous water phase, including oxygen-supplying salts dissolved in water, dispersed in a continuous oil phase including light and/or heavy oils and emulsifying aids and agents. Emulsification under low to high shear process stabilizes the product. The predominant oxygen-supplying salt is ammonium nitrate, although sodium nitrate and calcium nitrate, as well as mixtures of these nitrate salts, are frequently used. Explosive compositions based on oil-in-water emulsions also are known and are included within the meaning of "water containing explosives" for the purposes of this invention.

Other water containing explosives include slurries and water gels. Water gels are characterized by the presence of gums (e.g. galacto-mannan gums), thickeners, acids and cross-linking agents to provide a stable product. These water containing explosives typically contain in excess of 5% by weight of water and may contain up to about 20% by weight or more of water. Typically about 7 to 17% by weight of water is present.

The presence of water in an explosive composition reduces the available thermo-chemical energy provided by the dissolved salts and their fuels. A discrete salt phase (which will not substantially dissolve in the water-containing or "concentrate" phase) frequently is blended into an intermediate or final mixture to increase the total available thermo-chemical energy. This salt phase may also carry entrained air and thus reduce mixture density and add so-called "hot spots" which improve detonation sensitiveness. These salt phase-supplemented water-containing explosives are known in the industry as "heavy ANFO."

ANFO, heavy ANFO, and other water-containing explosives are "non-ideal" explosives. Non-ideal explosives are products whose detonation and explosion state efficacies are relatively dependent upon their exterior "environment," and upon their criticality of diameter and density. By industry parlance the "environment" may include: (1) the structural nature of the rock to be blasted, (2) the type and degree of confinement of the product charged into the blast hole, (3) primer strength which will detonate the main charge, (4) blast geometry, shot balance and initiator delay firing pattern, (5) temperatures and humidity during product storage and during shot loading, (6) blast hole waterhead pressure, and (7) the effect of transient pressures from adjacent firing holes.

"Ideal" explosives, on the other hand, tend to perform independently of their exterior environment. Examples include nitroglycerin, PETN, RDX and TNT; these are well known high explosives which are frequently labelled as "molecular explosives."

It is well known by those skilled in the art and science of explosives that during the detonation state and explosion state reactions the maximum theoretical energy values of a mixture seldom, if ever, are reached, but may become more fully available when certain enhancing agents have been added to the formulation. Such agents by common parlance have been called sensitizers, energy enhancers, fuel boosters, etc. For purposes of this application these terms are combined into a single phrase to better describe their true function and contribution—Sensitizing Energy Release Agent.

Currently popular sensitizing energy release agents include but are not limited to the following groups: (1) molecular explosives, (2) aluminum granules, flakes and powders, (3) certain energetic chemicals such as, but not limited to, amine nitrates, nitroparaffins and perchlorates, and (4) spherical particles of encapsulated air or other gas. Spherical particles ("microspheres") may be closed or open cell, and range in useful diameters for explosives from about 10 microns to about 350 microns. Generally, a shell midrange diameter of about 40 to 100 microns is preferred. Shell materials of the closed cell microspheres are typically of ceramic, glass or glass-like, phenolic or polyethylene materials. Most open cell types are perlites. Particle or liquid displacement densities of the popular varieties vary from 0.03 g/cc for polyethylene to about 0.7 g/cc for aluminum silicates (ceramics). The term "hollow glass microspheres" is frequently applied to the ceramics, the glass-like spheres, and even to perlites.

Until recently, water-containing explosives (WCE) most frequently have been sensitized by (1) incorporating energetic chemicals as part of a host matrix or concentrate, (2) adding from about 0.3% to about 7% by bulk weight of hollow glass microspheres, or (3) adding about 0.5% to about 30% by weight of aluminum particles. Sometimes both hollow glass microspheres and aluminum particles are used.

The addition of hollow glass microspheres reduces host density from above its critical density to below its critical density. In so doing, the microspheres also provide or increase the number of "hot spots" necessary in non-ideal explosives for continuation of the detonation wave front. Aluminum particles beneficially add to the heats of detonation and explosion, thus increasing resultant pressures to better fracture and displace the material being blasted.

It is known that superior blasting efficacy can be obtained with blasting agents made of 87–82% comminuted ammonium nitrate prills (AN), fueled and sensitized with 13–17% of 2–3 carbon nitroalkanes. Mixtures of 13% nitropropane / 87% AN or 17½% nitroethane/82½% AN are oxygen balanced to near zero. These blasting agents are considerably more energetic than the ANFO compositions they may replace.

Those skilled in the art also know that low viscosity long chain hydrocarbons, e.g., No. 2 diesel fuel (fuel oil or FO) can economically replace the pure fuel contribution of the nitroalkane utilized as described. Nitropropane is oxygen deficient (negative) by 135 gram-atoms per 100 grams whereas fuel oil is generally recognized as negative 346 gram atoms per 100 grams. Thus for considerations of oxygen balance alone each weight percent of fuel oil can replace 2.56 weight percent of nitropropane. This trade-off in favor of fuel oil, for reasons of economy, is at the expense of otherwise available energy enhancement.

It is known from Edwards et al., U.S. Pat. No. 4,273,049, that a satisfactory bulk blasting agent is achieved with a mixture of about 90% ammonium nitrate, about 7% nitropropane and about 3% fuel oil.

This type of bulk blasting agent has no water resistance, however, and must be utilized in dry blast holes or with flexible plastic liners in de-watered blast holes. Also, since it contains no thickening agent it must be mixed and used reasonably promptly before the fuel oil and nitroalkane migrate away from the ammonium nitrate, thus reducing sensitiveness.

My earlier U.S. Pat. No. 4,867,813 (also assigned to W. R. Grace & Co.-Conn.) describes the sensitization of the salt phase of water-containing explosives with nitroparaffin(s) or mixtures of nitroparaffins and arenes. These compositions advantageously provide a sensitized explosive while maintaining the water resistance and stability of the host.

SUMMARY OF THE INVENTION

It is an object of this invention to provide improved water-containing explosives which are sensitized in their concentrate phase with nitroparaffin-based sensitizing energy release agents, the sensitized concentrate remaining suitably stable over extended periods of time.

Another object of this invention is to provide nitroalkane/arene sensitizing energy release agents for sensitizing the concentrate phase of water-containing explosives of the emulsion, "heavy ANFO," slurry and water gel types.

It is a further object of this invention to provide methods for appropriately introducing the improved nitroparaffin sensitizing energy release agent into the concentrate phase of its respective hosts while maintaining the water resistance and emulsion stability of the product.

Other objects and advantages will become apparent to those skilled in the art from the disclosure herein.

This invention advantageously provides improved non-ideal water-containing explosives through the addition of nitroalkanes, especially 2 and 3 carbon mono-nitro alkanes in nitroalkane/arene mixtures, to the concentrate phase of the earlier-described types of water-containing explosives. The thus-sensitized concentrates are suitably stable over extended periods of time.

In one aspect, the present invention relates to a method for preparing a concentrate-phase sensitized water-containing explosive comprising the steps of treating the concentrate phase (often a stable water-in-oil emulsion containing a hydrocarbon fuel) with a nitroalkane/arene sensitizing mixture and then combining the sensitized concentrate with the salt phase of an explosive composition.

In another aspect, the present invention relates to a method for preparing a sensitizing composition for a water-containing emulsion comprising the steps of mixing one or more nitroalkanes with an arene, optionally in the presence of an indicator, and then adding the resulting mixture to a host concentrate phase.

Advantageously the sensitized concentrate phase can be prepared well in advance of the combining of the salt and concentrate phases.

DETAILED DESCRIPTION

The sensitizing energy release agents of the present invention include nitroalkanes. The $C_2$–$C_3$ mono-nitro alkanes are preferred, although lower and higher mono- and poly-nitro alkanes also would be useful and are encompassed by the terms "nitroalkane" and "nitroparaffin" as used herein. Nitroethane and 1-nitropropane, and mixtures (blends) thereof, are especially preferred in view of their commercial availability and ease of handling. Nitroalkanes and blends thereof are purchased from W. R. Grace & Co.-Conn., Organic Chemicals Division, Lexington, Mass. Nitroethane (NE) and 1-nitropropane (1-NP) are desirable for use as they are relatively safe to handle. Unlike molecular explosives, these materials are not shock sensitive. The present sensitizing energy release agents further include arene coupling agents which promote intimate contact between the nitroalkane(s) and the fuel component in the concentrate phase as well as mixture stability. Examples of useful arenes include the mono-, di-, and tri-methyl substituted benzenes in their various spatial orientations. More particularly, these arenes include toluene, xylene, hemimellitine, pseudocumene and mesitylene. Of these, the tri-methyl substituted benzenes (TMB's) are preferred for reasons of miscibility and lower cost.

Those skilled in the art will be familiar with useful water-containing explosive compositions which are sensitized according to the present invention. The nitroparaffin-based sensitizing energy release agents are nearly instantly miscible with the fuel oil or other hydrocarbon fuel component of the concentrate (e.g. emulsion) phase of such explosives. Advantageously, the sensitized emulsion remains stable, resulting in a commercially useful product.

Nitroalkane blends of from about 10 to 90 weight percent nitroethane and about 90 to 10% 1-nitropropane, especially about 30 to 70% nitroethane and about 70 to 30% 1-nitropropane are preferred for use in the sensitizing agents of the invention. Preferred sensitizing agents contain about 60 to about 95% by weight of nitroalkane and about 40 to about 5% by weight of arene. The sensitizing energy release agents including nitroalkane(s), also known as nitroparaffins, and arene(s) are hereinafter referred to as "NP-SERA's" where NP denotes nitroparaffin.

Preferred nitroparaffin sensitizing energy release agent blends (percent by weight) for use when no. 2 diesel fuel or gas oil are fuel components in the water-containing host or concentrate range from NE/1-NP/TMB ratios of 52-77/38-0/10-23. For a nitroparaffin sensitizing energy release agent not containing 1-NP, the preferred range is NE/TMB ratios of 67-77/33-23. Blends including 1-NP are of NE/1-NP/TMB ratios of 52-57/38-27/10-16. A NE/1-NP/TMB 52/38/10 blend and a NE/TMB 77/23 blend is particularly preferred with no. 2 diesel fuel as a fuel component. Particularly preferred blends for use with a gas oil component include a NE/1-NP/TMB 57/27/16 blend and a NE/TMB 67/33 blend. Those skilled in the art will be able to determine useful blends when other hydrocarbon fuel sources are employed.

The nitroparaffin sensitizing energy release agent blends are prepared by mixing the respective components at low shear, ambient (room) temperature and under atmospheric pressure. If desired, an indicator (for example Automate Red B brand dye, a product of Dresser Industries) is added to signify that the final, resultant concentrate is uniformly and homogeneously sensitized. By way of example, the nitroparaffins first are mixed together and the indicator dye is added thereto. The dyed nitroparaffins are mixed with the tri-methyl benzene to produce the nitroparaffin sensitizing energy release agent. The nitroparaffin sensitizing energy release agent is combined with an emulsion phase of a known water-containing explosive composition to produce a stable, sensitized concentrate. At the time of use, the sensitized concentrate phase is added to the ammonium nitrate (AN) or ammonium nitrate/fuel oil (ANFO) salt phase to produce an explosive composition. The choice of AN vs. ANFO, as known to those skilled in the art, is based upon oxygen balance requirements. Other salts, such as sodium and/or calcium nitrate, also may be employed in the salt phase of the finished product explosive composition. The salts are provided in granular, flake, prill and/or comminuted prill form.

Weight percentages of the components are varied by those skilled in the art in order to obtain a near-zero oxygen balance (OB) of the final explosive product. The practical range for the OB of the nitroparaffin sensitizing energy release agent varies from about negative 130 gram-atoms to about negative 180 gram-atoms per 100 grams of product. This range allows for subsequent sensitization of the stable emulsion concentrate to accommodate concentrate OB as high as negative 15. The addition of nitroparaffin sensitizing energy release agent in amounts of about 1 to about 4 weight percent, especially about 2 to about 3 weight percent, based on the total finished product weight of the explosive composition, is preferred. The ultimate finished product will advantageously have a final OB of about zero. The option of providing even higher energy, when required, can be achieved by adjusting the nitroparaffin sensitizing energy release agent content above 4 percent by weight and correspondingly adjusting the salt proportion in the concentrate phase and/or the salt/fuel proportion in the salt phase. Use of the inventive sensitizing energy release agents in combination with known sensitizing agents including microspheres, aluminum, amine nitrate and perchlorate also is contemplated.

Although the invention has been described in connection with certain preferred compositions and methods, it is not so limited. Those skilled in the art will readily determine specific useful compositions within the scope of the claims, based on specific requirements of specific applications. Thus, variations within the scope of the appended claims will be apparent to those skilled in the art.

I claim:

1. A process for preparing a concentrate-phase sensitized water-containing explosive composition having a salt phase and a concentrate phase containing a fuel, comprising:

(a) preparing a sensitized concentrate phase by treating the concentrate phase with a sensitizing mixture comprising nitroalkane and arene; and (b) mixing said sensitized concentrate phase with a salt phase.

2. A process of claim 1 wherein said salt comprises a nitrate salt.

3. A process of claim 2 wherein said nitrate salt comprises ammonium nitrate.

4. A process of claim 2 wherein said nitrate salt comprises sodium nitrate.

5. A process of claim 2 wherein said nitrate salt comprises calcium nitrate.

6. A process of claim 1 wherein said oxidizing salt comprises ammonium nitrate, sodium nitrate and/or calcium nitrate.

7. A process of claim 1 wherein said oxidizing salt is in the form of prills, comminuted prills, flakes or grains.

8. A process of claim 1 wherein said sensitizing mixture comprises about 60 to about 95% by weight of nitroalkane and about 40 to about 5% by weight of arene.

9. A process of claim 1 wherein said nitroalkane comprises nitromethane, nitroethane and/or nitropropane and said arene comprises mono-, di-, or tri- methyl substituted benzene.

10. A process of claim 1 wherein said arene comprises tri-methyl substituted benzene.

11. A process of claim 1 wherein said sensitizing mixture comprises nitroalkane and arene in amounts sufficient to provide an oxygen balance of about zero in the water-containing explosive finished product.

12. A process of claim 8 wherein said arene comprises pseudocumene.

13. A process of claim 1 wherein said sensitizing mixture further comprises an indicator.

14. A process of claim 1 wherein said concentrate comprises an emulsion comprising no. 2 diesel fuel.

15. A process of claim 1 wherein said concentrate comprises an emulsion comprising gas oil.

16. A process of claim 1 wherein said sensitizing mixture comprises, by weight, about 52 to about 77 percent nitroethane, about 38 to about 0 percent 1-nitropropane and about 10 to about 23 percent trimethyl benzene.

17. A process of claim 1 wherein said sensitizing mixture comprises, by weight, about 67 to about 77 percent nitroethane and about 33 to about 23 percent tri-methyl benzene.

18. A process of claim 1 wherein said sensitizing mixture comprises, by weight, about 52 to about 57 percent nitroethane, about 38 to about 27 percent 1-nitropropane and about 10 to about 16 percent trimethyl benzene.

19. A process of claim 1 wherein said fuel comprises no. 2 diesel fuel and said sensitizing mixture comprises, by weight, about 52 percent nitroethane, about 38 percent 1-nitropropane and about 10 percent tri-methyl benzene.

20. A process of claim 1 wherein said fuel comprises no. 2 diesel fuel and said sensitizing mixture comprises, by weight, about 77 percent nitroethane and about 23 percent tri-methyl benzene.

21. A process of claim 1 wherein said fuel comprises gas oil and said sensitizing mixture comprises, by weight, about 57 percent nitroethane, about 27 percent 1-nitropropane and about 16 percent tri-methyl benzene.

22. A process of claim 1 wherein said fuel comprises gas oil and said sensitizing mixture comprises, by weight, about 67 percent nitroethane and about 33 percent tri-methyl benzene.

23. A sensitized water-containing explosive composition comprising a salt phase and a concentrate phase, the concentrate phase comprising a sensitizing amount of a mixture of a nitroalkane and an arene.

24. An explosive composition of claim 23 wherein the nitroalkane comprises nitromethane, nitroethane and/or nitropropane.

25. An explosive composition of claim 23 wherein the arene comprises a tri-methyl substituted benzene.

26. An explosive composition of claim 23 wherein the concentrate phase comprises about 2 to about 10 percent of said mixture of a nitroalkane and an arene.

27. An explosive composition of claim 23 wherein said mixture comprises, by weight, about 52 to about 77 percent nitroethane, about 38 to about 0 percent 1-nitropropane and about 10 to about 23 percent trimethyl benzene.

28. An explosive composition of claim 23 wherein said mixture comprises, by weight, about 67 to about 77 percent nitroethane and about 33 to about 23 percent tri-methyl benzene.

29. An explosive composition of claim 23 wherein said mixture comprises, by weight, about 52 to about 57 percent nitroethane, about 38 to about 27 percent 1-nitropropane and about 10 to about 16 percent trimethyl benzene.

30. An explosive composition of claim 23 wherein said concentrate phase comprises no. 2 diesel fuel and said mixture comprises, by weight, about 52 percent nitroethane, about 38 percent 1-nitropropane and about 10 percent tri-methyl benzene.

31. An explosive composition of claim 23 wherein said concentrate phase comprises no. 2 diesel fuel and said mixture comprises, by weight, about 77 percent nitroethane and about 23 percent tri-methyl benzene.

32. An explosive composition of claim 23 wherein said concentrate phase comprises gas oil and said mixture comprises, by weight, about 57 percent nitroethane, about 27 percent 1-nitropropane and about 16 percent tri-methyl benzene.

33. An explosive composition of claim 23 wherein said concentrate phase comprises gas oil and said mixture comprises, by weight, about 67 percent nitroethane and about 33 percent tri-methyl benzene.

34. In a process for preparing a concentrate phase of a water-containing explosive composition, the improvement comprising sensitizing the concentrate phase with a sensitizing mixture of a nitroalkane and an arene.

35. A process of claim 34 wherein said nitroalkane comprises nitroethane.

36. A process of claim 34 wherein said nitroalkane comprises nitropropane.

37. A process of claim 34 wherein said arene comprises tri-methyl benzene.

38. A process of claim 34 wherein said nitroalkane comprises nitromethane.

* * * * *